US006032871A

United States Patent [19]

Börner et al.

[11] Patent Number: 6,032,871

[45] Date of Patent: Mar. 7, 2000

[54] ELECTROSTATIC COATING PROCESS

[75] Inventors: Gunter Börner, Mühlhausen; Hans Christoph Nienburg, Heidelberg; Jorg Sopka, Schwetzingen, all of Germany

[73] Assignee: ABB Research Ltd., Zuerich, Switzerland

[21] Appl. No.: 09/115,880

[22] Filed: Jul. 15, 1998

[30] Foreign Application Priority Data

Jul. 15, 1997 [DE] Germany ..... 197 30 231

[51] Int. Cl.[7] ..... B05B 5/00

[52] U.S. Cl. ..... 239/3; 239/695; 239/708; 427/475; 427/479; 427/485; 427/486; 118/629

[58] Field of Search ..... 239/708, 695, 239/3; 427/485, 486, 475, 479; 118/629

[56] References Cited

U.S. PATENT DOCUMENTS

| | | | |
|---|---|---|---|
| 3,323,934 | 6/1967 | Point | 239/695 |
| 4,702,932 | 10/1987 | Cosentino et al. | 118/629 |
| 4,703,891 | 11/1987 | Jackson et al. | 239/695 |
| 5,222,663 | 6/1993 | Noakes et al. | 239/3 |
| 5,514,423 | 5/1996 | Krish et al. | 427/479 |

FOREIGN PATENT DOCUMENTS

| | | |
|---|---|---|
| 0 437 383 A1 | 7/1991 | European Pat. Off. . |
| 0 468 735 A1 | 1/1992 | European Pat. Off. . |
| 24 55 161 C2 | 5/1975 | Germany . |
| 27 31 342 A1 | 1/1979 | Germany . |
| 36 00 065 A1 | 7/1987 | Germany . |
| 195 42 863 A1 | 5/1997 | Germany . |

OTHER PUBLICATIONS

Patent Abstracts of Japan No. 60–227852 A (Matsubara), dated Nov. 13, 1985, "Electrostatic agricultural chemical sprinkler".

Defazet, 31th year of public., No. 8/1977, pp. 313–317 (Hoppe), "Electrostatic Powder Sprinkling".

*Primary Examiner*—Kevin Shaver
*Assistant Examiner*—David Deal
*Attorney, Agent, or Firm*—Herbert L. Lerner; Laurence A. Greenberg; Werner H. Stemer

[57] ABSTRACT

Workpieces are electrostatically coated with powder materials. It is possible to attain a relatively large coating thickness in a single operation by simultaneously or alternately coating with powder particles that have a different electrical charge. The process can be used in applying single-component or multi-component coating materials.

7 Claims, 2 Drawing Sheets

ELECTROSTATIC COATING PROCESS

BACKGROUND OF THE INVENTION

Field of the Invention

The invention relates to an electrostatic coating process, and more specifically, to a process for electrostatically coating workpieces with powder materials.

In electrostatic powder spraying, the powder particles are positively or negatively charged. The coating layer thickness which can be achieved with one coating operation is generally less than 500 $\mu$m, because the charge of powder particles that have already been applied has a repulsion effect on subsequent powder particles bearing a charge of the same sign. For many technical applications, such as electrical or thermal insulating layers, the coating thickness achievable in this way is inadequate. In that case, multiple coating with coat sintering is required.

SUMMARY OF THE INVENTION

It is accordingly an object of the invention to provide an electrostatic coating process, which overcomes the above-mentioned disadvantages of the prior art devices and methods of this general type and which achieves a greater desired coating thickness in one operation.

With the foregoing and other objects in view there is provided, in accordance with the invention, a process for electrostatically coating workpieces with powder materials, which comprises:

electrically charging powder particles of a coating material with a differing electrical charge and coating a workpiece with the differently charged powder particles by means of at least two electrostatic application devices.

The coating material may be a single-component or a multi-component coating material.

In accordance with an added feature of the invention, the coating process comprises simultaneously operating at least two application devices and applying the powder particles of the single-component coating material with the at least two application devices, wherein at least one of the application devices applies powder particles having a positive electrical charge and at least one of the application devices applies powder particles having a negative electrical charge.

In accordance with an additional feature of the invention, at least two application devices are simultaneously operated and the powder particles of a first material component are charged to a positive electrical charge in at least one of the application devices and the powder particles of a second material component are charged to a negative electrical charge in another of the application devices.

In accordance with another feature of the invention, the coating step comprises alternately applying, with at least two coating devices, coating layers with particles having a positive electrical charge and with particles having a negative electrical charge onto the workpiece.

In accordance with a further feature of the invention, the particles having a positive electrical charge and the particles having a negative electrical charge are particles of a single-component coating material. Alternatively, the differently charged particles are different components of a multi-component coating material.

A powder spraying apparatus that is suitable for implementing the process is described, for example, in the German published non-prosecuted patent application DE 195 42 863 A1. Simultaneous or alternate spraying of positively and negatively charged powder can be achieved if, in accordance with a concomitant feature of the invention, at least one of the application devices is a corona spray gun and at least one of the application devices is a triboelectric spray gun.

Other features which are considered as characteristic for the invention are set forth in the appended claims.

Although the invention is illustrated and described herein as embodied in an electrostatic coating process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
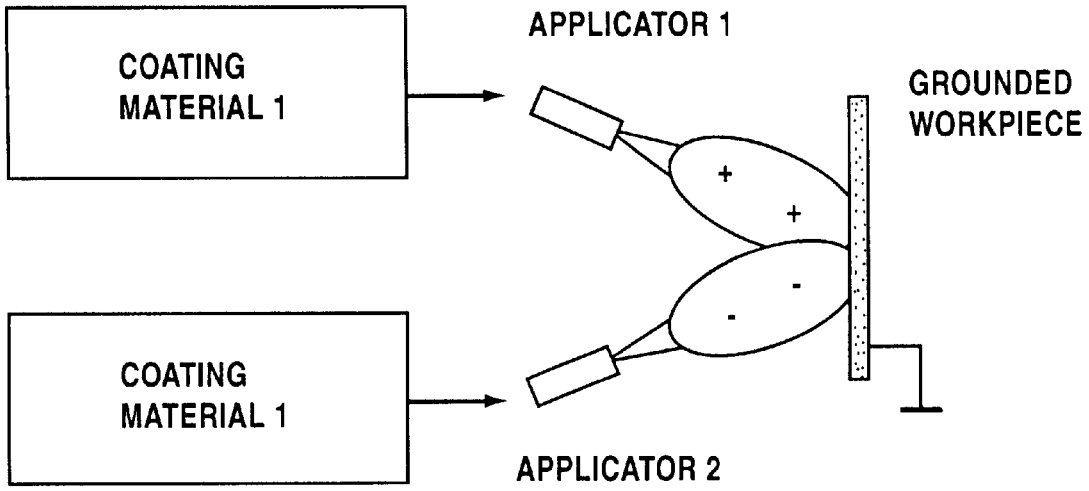
FIG. 1 is a schematic view of a coating operation in which a single-component coating material is applied.

DESCRIPTION OF THE PREFERRED EMBODIMENTS:

Referring now to the figures of the drawing in detail, each of the exemplary embodiments of the invention use a grounded workpiece and at least two applicators 1, 2.

Referring now specifically to FIG. 1, there is shown a first process variant in which a single-component coating material 1 is applied by means of two electrostatic application devices which are referred to as applicators 1, 2. The applicator 1 sprays positively charged particles of the coating material 1 and the applicator 2 sprays negatively charged particles onto the workpiece. The applicators 1 and 2 operate simultaneously. Instead of two applicators it is also possible for more applicators to apply, simultaneously, particles differing in charge. As a result of the simultaneous deposition of particles that have a different electrical charge, the surface charge on the workpiece is lower than in the case of a coating with particles having only one charge. As a result, the powder coating thickness is substantially increased as compared with the prior art.

Figure 2:
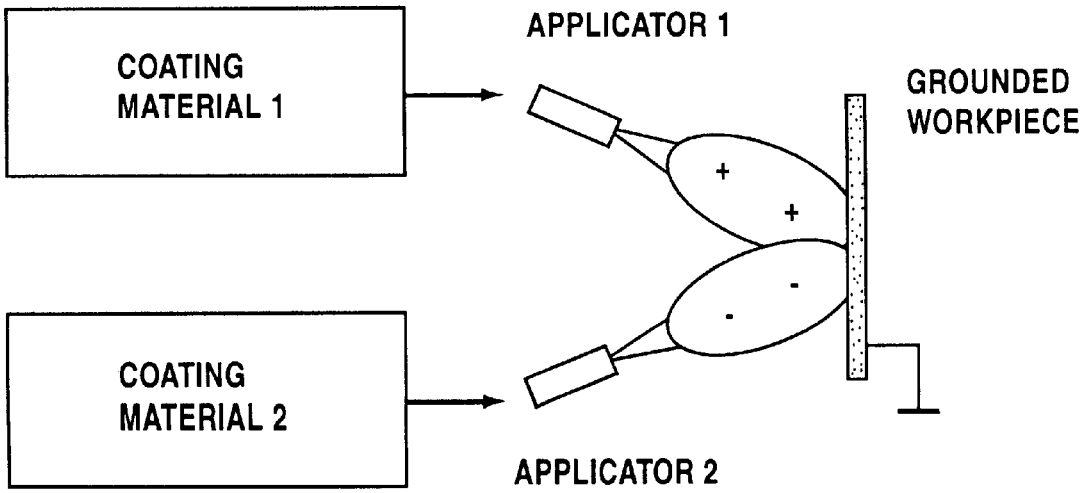
FIG. 2 is a schematic view of a coating operation in which a two-component coating material is applied.

Referring now to the second embodiment illustrated in FIG. 2, spraying is likewise carried out simultaneously by two applicators 1, 2. Here, however, a first material component, referred to as coating material 1, receives a positive charge, and a second material component, referred to as coating material 2, receives a negative charge.

By means of such a process it is possible, for example, to produce electrical insulation of copper wires using mica-filled thermoplastics. In co-powder coating, for example, a polymer powder is applied with a triboelectric spray gun. In this case the powder particles are positively charged. The mica particles are applied simultaneously using, for example, a corona spray gun. In this type of electrostatic powder application the mica particles adopt a negative charge. The layer composition, i.e. the mica content, is regulated by harmonizing the mass flows of powder.

Figure 3:
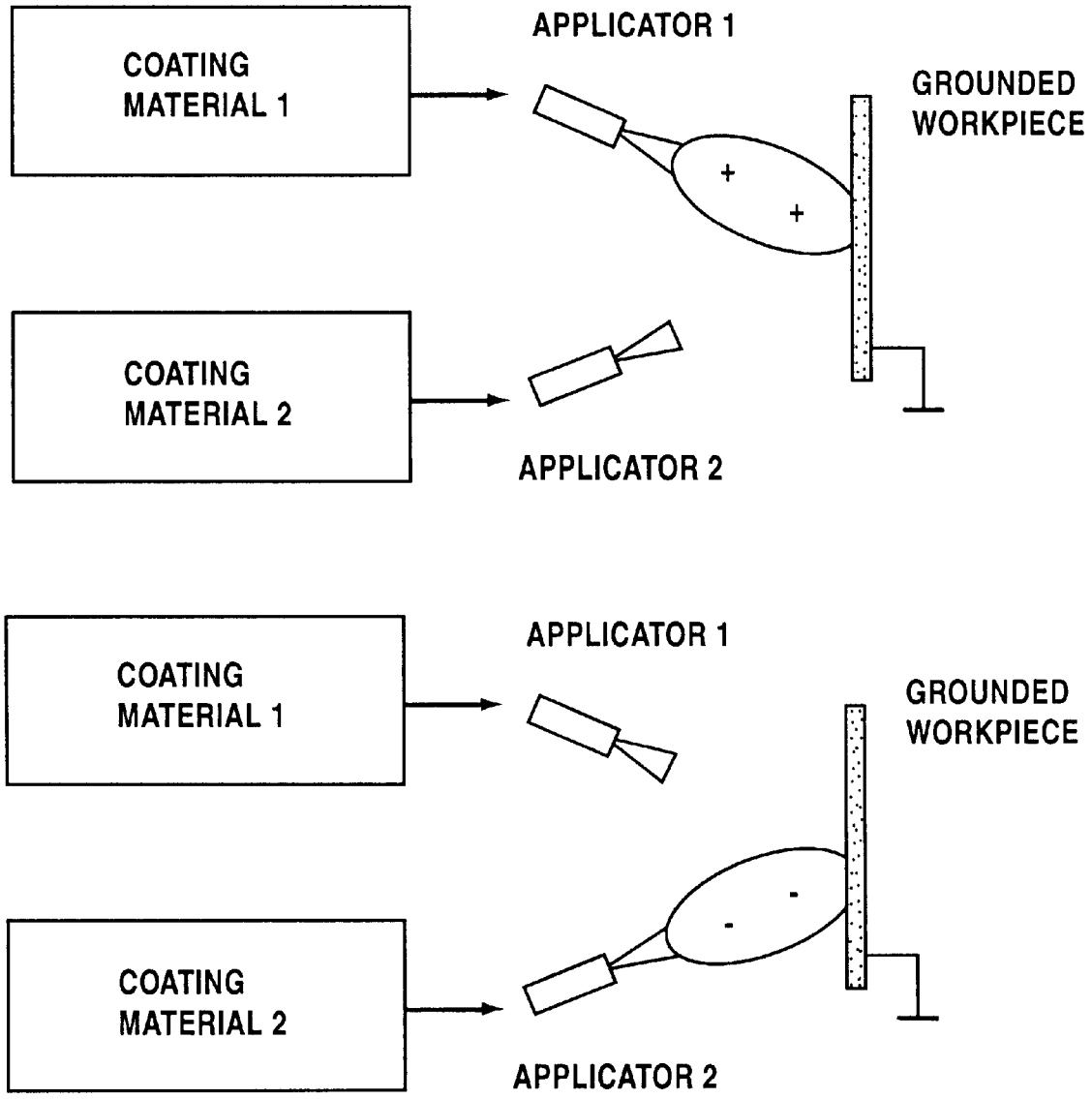
FIG. 3 is a schematic of a coating operation in which layers of material differing in electrical charge are sprayed on alternately.

FIG. 3 illustrates a third embodiment of the process. Similar to the second embodiment (FIG. 2), two different materials are applied with differing electrical charges. The coating materials 1, 2, however, are applied alternately in relatively thin coats beginning, for example, with a coating of the material 1, as shown in the upper portion of FIG. 3. Following this, a coating layer of the second material is applied, which has a different charge, as shown in the lower portion of FIG. 3. Alternate coating with positively and negatively charged particles is repeated until the desired overall coating thickness is obtained. Here too, a greater overall coating thickness is achieved than would be possible by spray application of particles having only one uniform charge.

The third process variant can also be used for coating with a single-component coating material, with the particles applied being alternately of the same size but differing in charge.

We claim:

1. A process for electrostatically coating a workpiece with coating materials, which comprises:

electrically charging powder particles of a coating material with a different electrical charge by means of two electrostatic application devices of opposite polarity;

coating a workpiece with the differently charged powder particles by simultaneously operating the at least two electrostatic application devices, wherein one of the electrostatic application devices is a corona spray gun and the other electrostatic application devices is a triboelectric spray gun.

2. The process according to claim 1, wherein the coating material is a single-component coating material.

3. The process according to claim 1, wherein the coating material is a multi-component coating material.

4. The process according to claim 1, wherein the coating step comprises alternately applying, with at least two coating devices, coating layers with particles having a positive electrical charge and with particles having a negative electrical charge onto the workpiece.

5. The process according to claim 4, wherein the particles having a positive electrical charge and the particles having a negative electrical charge are particles of a single-component coating material.

6. The process according to claim 4, wherein the particles having a positive electrical charge and the particles having a negative electrical charge are particles of a multi-component coating material.

7. The process according to claim 1, wherein at least one of the application devices is a corona spray gun and at least one of the application devices is a triboelectric spray gun.

* * * * *